US011640887B2

(12) United States Patent
Delpozzo et al.

(10) Patent No.: US 11,640,887 B2
(45) Date of Patent: May 2, 2023

(54) MECHANICAL LATCHING SYSTEM KIT FOR A MEDIUM VOLTAGE CONTACTOR

(71) Applicant: ABB Schweiz AG, Baden (CH)

(72) Inventors: Andrea Delpozzo, Torbiato di Adro (IT); Emanuele Morelli, Linarolo (IT); Gabriele Gasparini, Bergamo (IT); Osvaldo Prestini, Nembro (IT)

(73) Assignee: ABB SCHWEIZ AG, Baden (CH)

( * ) Notice: Subject to any disclaimer, the term of this patent is extended or adjusted under 35 U.S.C. 154(b) by 361 days.

(21) Appl. No.: 16/636,445

(22) PCT Filed: Jul. 16, 2018

(86) PCT No.: PCT/EP2018/069261
§ 371 (c)(1),
(2) Date: Feb. 4, 2020

(87) PCT Pub. No.: WO2019/034349
PCT Pub. Date: Feb. 21, 2019

(65) Prior Publication Data

US 2020/0176204 A1 Jun. 4, 2020

(30) Foreign Application Priority Data

Aug. 14, 2017 (EP) ..... 17186116

(51) Int. Cl.
*H01H 33/38* (2006.01)
*H01H 33/46* (2006.01)
*H01H 33/666* (2006.01)

(52) U.S. Cl.
CPC ..... *H01H 33/666* (2013.01); *H01H 33/38* (2013.01); *H01H 33/46* (2013.01)

(58) Field of Classification Search
CPC ..... H01H 33/666; H01H 33/38; H01H 33/46; H01H 33/48; H01H 33/50; H01H 33/52;
(Continued)

(56) References Cited

U.S. PATENT DOCUMENTS 3,636,292 A 1/1972 Roth
4,292,611 A * 9/1981 Bresson ..... H01H 3/222 335/147

(Continued)

FOREIGN PATENT DOCUMENTS

CN 104078266 A 10/2014
CN 204884994 U 12/2015

(Continued)

OTHER PUBLICATIONS

Office Action, Counter CN Appln. No. 2018800401840, dated May 6, 2021, 5 pgs.

(Continued)

*Primary Examiner* — William A Bolton
(74) *Attorney, Agent, or Firm* — Greenberg Traurig, LLP

(57) ABSTRACT

A mechanical latching accessory kit for a Medium Voltage contactor including one or more movable contacts connected through a mechanical link to a contact actuator moving the one or more movable contacts between a contact open position and a contact closed position. The mechanical latching accessory kit includes: a supporting interface adapted to be fixed to and removed from the Medium Voltage contactor; a latching element movable between a first operating position and a second resting position; a latching actuating system moving the latching element between the first, operating, position and the second, resting, position; the latching element being adapted, when it is in the first operating position, to cooperate with the mechanical link of the Medium Voltage contactor to latch the one or more movable contacts, and, when it is in the second resting position, to release the one or more movable contacts.

20 Claims, 9 Drawing Sheets

(58) Field of Classification Search
CPC ..... H01H 9/22; H01H 50/32; H01H 51/10; H01H 71/24; H01H 2033/426
USPC ..... 335/154, 167; 218/118, 143; 361/13; 200/144 B
See application file for complete search history.

(56) References Cited

U.S. PATENT DOCUMENTS

| | | | | |
|---|---|---|---|---|
| 5,912,604 | A * | 6/1999 | Harvey | H01H 33/6662 218/138 |
| 7,843,293 | B1 * | 11/2010 | Bonjean | H01H 3/28 218/154 |
| 9,418,810 | B2 * | 8/2016 | Prestini | H01H 47/223 |
| 9,508,514 | B2 * | 11/2016 | Ohda | H01F 7/122 |
| 9,653,241 | B2 * | 5/2017 | Boffelli | H01H 33/666 |
| 2011/0046808 | A1 | 2/2011 | Kellis et al. | |
| 2015/0340185 | A1 * | 11/2015 | Takala | H01H 50/163 335/161 |

FOREIGN PATENT DOCUMENTS

| | | | |
|---|---|---|---|
| DE | 19631533 | A1 | 1/1998 |
| DE | 202008004868 | U1 | 7/2008 |
| EP | 2270823 | A1 | 1/2011 |
| EP | 3258473 | A1 | 12/2017 |
| EP | 3301700 | A1 | 4/2018 |
| EP | 3321950 | A1 | 5/2018 |

OTHER PUBLICATIONS

European Patent Office, International Search Report & Written Opinion issued in corresponding Application No. PCT/EP2018/069261, dated Oct. 15, 2018, 14 pp.

European Patent Office, Extended Search Report issued in corresponding Application No. 17186116.4, dated Feb. 12, 2018, 8 pp.

Chinese Second Office Action, issued by the China National Intellectual Property Administration, regarding corresponding patent application Serial No. CN 201880040184.0; dated Jan. 10, 2022; 5 pages (Untranslated).

* cited by examiner

MECHANICAL LATCHING SYSTEM KIT FOR A MEDIUM VOLTAGE CONTACTOR

The present invention relates to a mechanical latching accessory kit for a Medium Voltage contactor (e.g. a vacuum contactor), in particular to a mechanical latching accessory kit for an electrically latched Medium Voltage contactor.

For the purpose of the present application, the term "medium voltage" (MV) relates to operating voltages at electric power distribution levels, which are higher than 1 kV AC and 1.5 kV DC up to some tens of kV, e.g. up to 72 kV AC and 100 kV DC.

As is known, MV electric systems typically adopt two different kinds of switching devices. A first type of switching devices, including for example circuit breakers, is basically designed for protection purposes, namely for carrying (for a specified time interval) and breaking currents under specified abnormal circuit conditions, e.g. under short circuit conditions.

A second type of switching devices, including for example contactors, is basically designed for manoeuvring purposes, namely for carrying and breaking currents under normal circuit conditions including overload conditions. MV vacuum contactors represent a widely used type of MV contactors.

These apparatuses are suitable for installation in harsh environments (such as in industrial and marine plants) and are typically used in control and protection of motors, transformers, power factor correction banks, switching systems, and the like.

Normally, a MV vacuum contactor comprises, for each electric pole, a vacuum bulb in which the electrical contacts are placed to mutually couple/decouple upon actuation by a suitable actuating device.

Some MV vacuum contactors of the state of the art (bi-stable contactors) adopt an electromagnetic actuator to move the movable contacts from an open position to a closed position with respect to the fixed contacts (closing manoeuvre of the contactor), and from a closed position to an open position with respect to the fixed contacts (opening manoeuvre of the contactor).

Other MV vacuum contactors of the state of the art (mono-stable contactors) adopt an electromagnetic actuator to move the movable contacts from an open position to a closed position with respect to the fixed contacts (closing manoeuvre of the contactor) and to hold the movable contacts in said closed position (closing state of the contactor).

Differently from bi-stable contactors, these apparatuses comprise opening springs to move the movable contacts from a closed position to an open position with respect to the fixed contacts (opening manoeuvre of the contactor).

In most cases, the MV contactors market requires the contactor being provided with an electrically latched electromagnetic actuation, typically comprising a closing coil, an electrical holding function, and a tripping spring. However, a considerable number of applications require a dedicated version with a latching function in closed position, typically comprising a closing coil, a mechanical latching/holding in closed position system, and a tripping coil.

Electrically and mechanically latched contactors target different applications and different market segments due to different functional features.

In particular, an electrical latching system has an active coil-driven closing command and a passive spring-driven tripping command, and the closed position is maintained by means of a holding current with consequent power consumption in holding. In practice, an electrical latch has one stable position of rest (i.e., the open position) and the opening operation has highest priority (i.e., the spring-driven actuator trips the device in case of loss of auxiliary power).

Conversely, a mechanical latch has an active coil-driven closing command and an active coil-driven tripping command, and the closed position is maintained by a latch that can be, e.g., mechanical or permanent magnet based, and consequently there is no power consumption in holding. In practice, a mechanical latch has two stable positions of rest (i.e., both open and closed position) and the holding of present position has highest priority (i.e. the device avoids transitions and keeps the present position in case of loss of auxiliary power).

From a production standpoint, for most of the existing MV vacuum contactors on the market the electrically and mechanically latched versions of the contactors are differentiated by implementing during the production process in the factory dedicated different versions of the product.

In some cases, e.g. the ABB VSC-type contactors, a double-coil bi-stable permanent magnet-based actuator is used. The actuator is switched and tuned as electrically or mechanically latched device by changes in the embedded electronic control board.

In both cases the change between electrical and mechanical latching system must be implemented by the manufacturer during the production phase and not by the customer or on-site during the commissioning phase.

This is in strike contrast with the technological and market trends in MV apparatuses and systems, since nowadays the market is moving towards basic product platforms that can be customized by means of optional accessory kits, in order to allow better production flexibility the selling of the product via distributors.

The main aim of the present invention is to provide a system for Medium Voltage contactors, in particular vacuum contactors, that allows solving or mitigating the above-mentioned problems.

More in particular, it is an object of the present invention to provide a system for Medium Voltage contactors, that allows using a common production platform for electrically and mechanically latched Medium Voltage contactors.

As a further object, the present invention is aimed at providing a system for Medium Voltage contactors, that allows customizing the contactor, in an electrically or mechanically latched version, according to the needs on the customer site, without any need of supervision by the manufacturer.

Still another object of the present invention is to provide a system for Medium Voltage contactors that can be easily manufactured at industrial level, at competitive costs with respect to the solutions of the state of the art.

In a further aspect, the present invention also relates to a Medium Voltage contactor, in particular a Medium Voltage vacuum contactor, comprising a system as described herein.

In order to fulfill these aim and objects, the present invention provides a mechanical latching accessory kit for a Medium Voltage contactor comprising one or more movable contacts connected through a mechanical link to a contact actuator moving said one or more movable contacts between a contact open position and a contact closed position. The mechanical latching accessory kit for a Medium Voltage contactor, according to the invention, is characterized in that it comprises: a supporting interface adapted to be fixed to and removed from said Medium Voltage contactor; a latching element movable between a first operating position and a second resting position; a latching actuating system moving said latching element between said first, operating, position and said second, resting, position; said latching element being adapted, when it is in said first operating position, to cooperate with the mechanical link of said. Medium Voltage contactor to latch said one or more movable contacts, and, when it is in said second resting position, to release said one or more movable contacts.

In this way, it is possible to provide a Medium Voltage contactor, particularly a Medium Voltage vacuum contactor, with a mechanical latching system by assembling the mechanical latching accessory kit of the present invention on a basic version of a Medium Voltage contactor without particular efforts.

In practice, with the system of the present invention, the mechanical latch is an accessorized version of a basic electrically-latched platform that can be used as is or transformed in a mechanically latched version with the simple operation of assembling the accessory kit, e.g., on the front side of the contactor.

Preferably, the mechanical latching accessory kit according with the present invention, is provided with a latching actuating system which comprises a first, mechanical, latching actuator moving the latching element from said second resting position to said first operating position and a second, electromagnetic, unlatching actuator moving the latching element from said first operating position to said second resting position.

In other words, according to this embodiment, the latching element is mechanically moved in the operating position using mechanical means and moved back to the resting position using electromagnetic means.

In particular, the mechanical latching accessory kit according to the invention, can be advantageously provided with a latching actuating system which comprises a first, mechanical, latching elastic actuator snap-moving the latching element from said second resting position to said first operating position and a second, electromagnetic, unlatching actuator which, when energized, moves the latching element from said first operating position to said second resting position contrasting the action of said first, mechanical, latching elastic actuator.

In other words, according to this embodiment, when the latching element is kept in the resting position, the mechanical elastic means of the latching actuator are in the loaded condition. When the latching element is released to carry out the latching operation on the Medium Voltage contactor to which it is attached, the mechanical elastic means snap and move the latching element into the operating position thereby latching the contact(s) of the Medium Voltage contactor in the desired position. Then, following a trip command which is sent to release the contact(s) of the Medium Voltage contactor, the electromagnetic means of the second unlatching actuator are energized and act on the latching element to bring it back from the operating position to the resting position, thereby unlatching the contact(s) of the Medium Voltage contactor. At the same time, during this movement, the mechanical elastic means of the latching actuator can be conveniently brought into their loaded condition so as to be ready to carry out a further latching action.

In an exemplary embodiment of the mechanical latching accessory kit as described above, said first, mechanical, latching elastic actuator comprises a compression spring which is compressed when said latching element is in said second resting position and is released when said latching element is in said first operating position. In other words, according to this embodiment, when the latching element is released to carry out the latching operation on the Medium Voltage contactor to which it is attached, the compressed spring is released and snap-moves the latching element into the operating position thereby latching the contact(s) of the Medium Voltage contactor in the desired position. Then, when the electromagnetic means of the second unlatching actuator are energized to carry out the unlatching operation, the latching element is brought back from the operating position to the resting position and, at the same time, the compression spring is compressed and brought into its loaded condition so as to be ready to carry out a further latching action.

From a construction standpoint, in an exemplary embodiment of the mechanical latching accessory kit, according to the present invention, said second, electromagnetic, unlatching actuator can conveniently comprise a fixed magnetic yoke, a tripping coil, and a movable magnetic plunger positioned inside said coil and operatively connected to said latching element, said movable magnetic plunger moving said latching element between said first, operating, position and said second resting position.

In practice, according to this embodiment, when the tripping coil is excited, the magnetic plunger is attracted inside the coils and pulls the latching element back into its resting position. Depending on he needs, different designs of the second, electromagnetic, unlatching actuator can be implemented.

Then, when the first, mechanical, latching elastic actuator of the mechanical latching accessory kit according to the present invention comprises a compression spring, said compression spring has conveniently one end which is rigidly connected to said fixed magnetic yoke and the other end which is rigidly connected to said movable magnetic plunger.

In this way, a very simple, but still very effective, design of the latching actuating system of the mechanical latching accessory kit of the present invention. However, different designs can be implemented according to the needs.

Starting from a basic design, the mechanical latching accessory kit of the present invention can be provided with a number of accessories depending on the needs.

For instance, the mechanical latching accessory kit of the present invention can be provided with switching means to switch on and off the feeding current of said second, electromagnetic, unlatching actuator. In practice, according to this embodiment, the mechanical latching accessory kit can be provided with an auxiliary switch to switch off the tripping current once the latch is released.

Also, as another example, the mechanical latching accessory kit of the present invention can be provided with a rectifier, for instance a diode rectifier, for handling both DC and AC supply of feeding current of said second, electromagnetic, unlatching actuator.

As previously said, the latching element of the mechanical latching accessory kit of the present invention is adapted, when it is in said first operating position, to cooperate with the mechanical link of said Medium Voltage contactor to latch said one or more movable contacts and, when it is in said second resting position, to release said one or more movable contacts.

In practice, according to a simple design concept of the mechanical latching accessory kit of the present invention, the latching element can be kept into its resting position by mechanical interference with the mechanical link of the Medium Voltage contactor to which it is attached. Then, when the mechanical link of the Medium Voltage contactor moves to carry out, e.g., a closing operation of the contact(s) of the Medium Voltage contactor, the latching element is made free to move and can be urged into the operating position by, e.g., the above-described mechanical latching actuator, e.g., a compression spring. In the operating position the latching element cooperate with the mechanical link of the Medium Voltage contactor to latch the movable contact(s). In practice, in order to latch the mechanical link of the Medium Voltage contactor the latching element can be inserted in a space between the mechanical link and another part of the Medium Voltage contactor so as to create mechanical interference and lock the mechanical link of the Medium Voltage. When the unlatching operation is carried out, the latching element is withdrawn from said space and brought back to its resting position, thereby allowing to execute the required movement of the mechanical link of the Medium Voltage contactor.

In view of the possible frictions of the latching element with the mechanical link and/or other parts of said Medium Voltage contactor, in a particular embodiment of the mechanical latching accessory kit, according to the present invention, said latching element can be conveniently provided with means for reducing the friction with the mechanical link and/or other parts of said Medium Voltage contactor. Such means for reducing the friction can be, e.g., one or more roller bearings.

As previously described, the mechanical latching accessory kit of the present invention, is provided with a latching actuating system very simple, but still very effective, that allows carrying out the mechanical latching and unlatching operations on the Medium Voltage contactor fully automatically.

According to a preferred embodiment of the mechanical latching accessory kit of the present invention, said latching actuating system can also comprise a manual unlatching actuator moving said latching element from said first operating position to said second resting position. In practice, in this embodiment, the latching actuating system can be equipped with an emergency tripping handle, or similar device, to manually release the latching element of mechanical latching accessory kit so as to unlatch and release the contact(s) of the Medium Voltage contactor.

In a further aspect, the present invention also relate to a Medium Voltage contactor, preferably a Medium Voltage vacuum contactor, which comprises a mechanical latching accessory kit as described herein.

In particular, the Medium Voltage contactor of the present disclosure, comprises one or more movable contacts which are connected through a mechanical link to a contact actuator moving said one or more movable contacts between a contact open position and a contact closed position. According to a particularly preferred embodiment of the present invention, the latching element of the mechanical latching accessory kit previously described cooperates with the mechanical link of said. Medium Voltage contactor for latching said one or more contacts in said closed position.

Examples of Medium Voltage contactors and of Medium Voltage contactor poles are described in patent applications EP16174129, EP16191442, and EP16198880, whose description is incorporated herein by reference.

In a possible form of execution of the Medium Voltage contactor of the present invention, the contact actuator typically comprises electromagnetic means which are energized to move said one or more movable contacts from said contact open position to said contact closed position, and spring means which moves said one or more contacts from said contact closed position to said contact open position.

In the absence of a mechanical latching system of the contact in the closed position, the electromagnetic means of the contact actuator need to remain energized in order to keep the one or more contacts of the Medium Voltage contactor in the closed position, otherwise said one or more contacts will be brought back into the open position under the action of the spring means of the contact actuator.

When using the mechanical latching accessory kit of the present invention, e.g., when upgrading a basic electrically latched electromagnetic actuator for MV Medium Voltage contactor into a mechanically latched actuator the electromagnetic means of said contact actuator can be de-energized once said one or more contacts are in the contact closed position, since the contact(s) can be hold in the closed position by the latching element of the mechanical latching accessory kit.

In a typical execution of a Medium Voltage contactor, the contact actuator can be a linear monostable electromagnetic actuator which comprises a coil, a fixed armature and a movable plunger, where the plunger is linearly moving to actuate the opening/closing operations of the contactor and is connected to the one or more contact(s) of the contactor via the mechanical link.

In an exemplary embodiment of the Medium Voltage contactor of the invention, the mechanical link of the contactor preferably comprises a rod which is operatively connected to said one or more movable contacts and to the contact actuator, e.g., the above-described movable plunger of the linear monostable electromagnetic actuator.

The rod linearly moves between said contact open position and said contact closed position, and is positioned with its longitudinal axis perpendicular with respect to the direction of its linear movement.

In order to actuate the latching operation of the contact(s) of the Medium Voltage contactor in the closed position, when said one or more movable contacts are in the closed position the latching element of said mechanical latching accessory is inserted in a space between said rod and a fixed element of said Medium Voltage contactor, e.g., the frame and/or a fixed part of the contactor, i.e. the latching element is in its first operating position.

The unlatching of said one or more movable contacts of the contactor is carried out by extracting the latching element from said space between the rod and a the element of the Medium Voltage contactor and moving it into its second resting position.

Conveniently, the movement of the latching element of the mechanical latching accessory kit between its operating and resting positions is therefore a linear movement perpendicular to the movement of the rod (and consequently of the contact actuator of the contactor) between the contact open position and the contact closed position.

A typical operating cycle of a typical Medium Voltage contactor equipped with a mechanical latching accessory kit according to the present invention can be described as follows.

In a typical exemplary embodiment of a Medium Voltage contactor, according to the invention, the contact actuator comprises electromagnetic means which are energized to move said rod from said contact open position to said contact closed position, and spring means for moving said rod from said contact closed position to said contact open position.

Once said one or more contacts are in the contact closed position, the latching element of the mechanical latching accessory kit is urged in the operating position in the space between the rod and a fixed element of the Medium Voltage contactor, thereby latching the contact(s) of the Medium Voltage contactor in the closed position, and the electromagnetic means of said contact actuator can be therefore de-energized.

Then, when said second, electromagnetic, unlatching actuator of the mechanical latching accessory kit is energized (e.g. following a tripping command of the Medium Voltage contactor), the latching element of said mechanical latching accessory kit moves from the inserted position in the space between the rod and a fixed element of said Medium Voltage contactor (operating position of the latching element) into an extracted position outside said space (resting position of the latching element), and the spring means of the contact actuator pull the rod from the contact closed position to the contact open position, thereby carrying out the opening operation of the contact(s) of the Medium Voltage contactor.

In this position, the space between the rod and a fixed element of the Medium Voltage contactor is closed and the latching element is prevented from entering the space and latch the contact(s) of the Medium Voltage contactor. The second, electromagnetic, unlatching actuator of the mechanical latching accessory kit can, under these conditions, be de-energized since the latching element is any case prevented from moving.

Then, when the electromagnetic means of the contact actuator of the Medium Voltage contactor are energized, the rod is moved from said contact open position to said contact closed position bringing the Medium Voltage contactor in the closed conditions, the space between the rod and a fixed element of the Medium Voltage contactor is open, and the latching element of the mechanical latching accessory kit is urged in the operating position in said space, thereby latching the contact(s) of the Medium Voltage contactor in the closed position.

Further features and advantages of the invention will emerge from the description of preferred, but not exclusive embodiments of the mechanical latching accessory kit for a Medium Voltage contactor, according to the invention, non-limiting examples of which are provided in the attached drawings, wherein.

Figure 1:
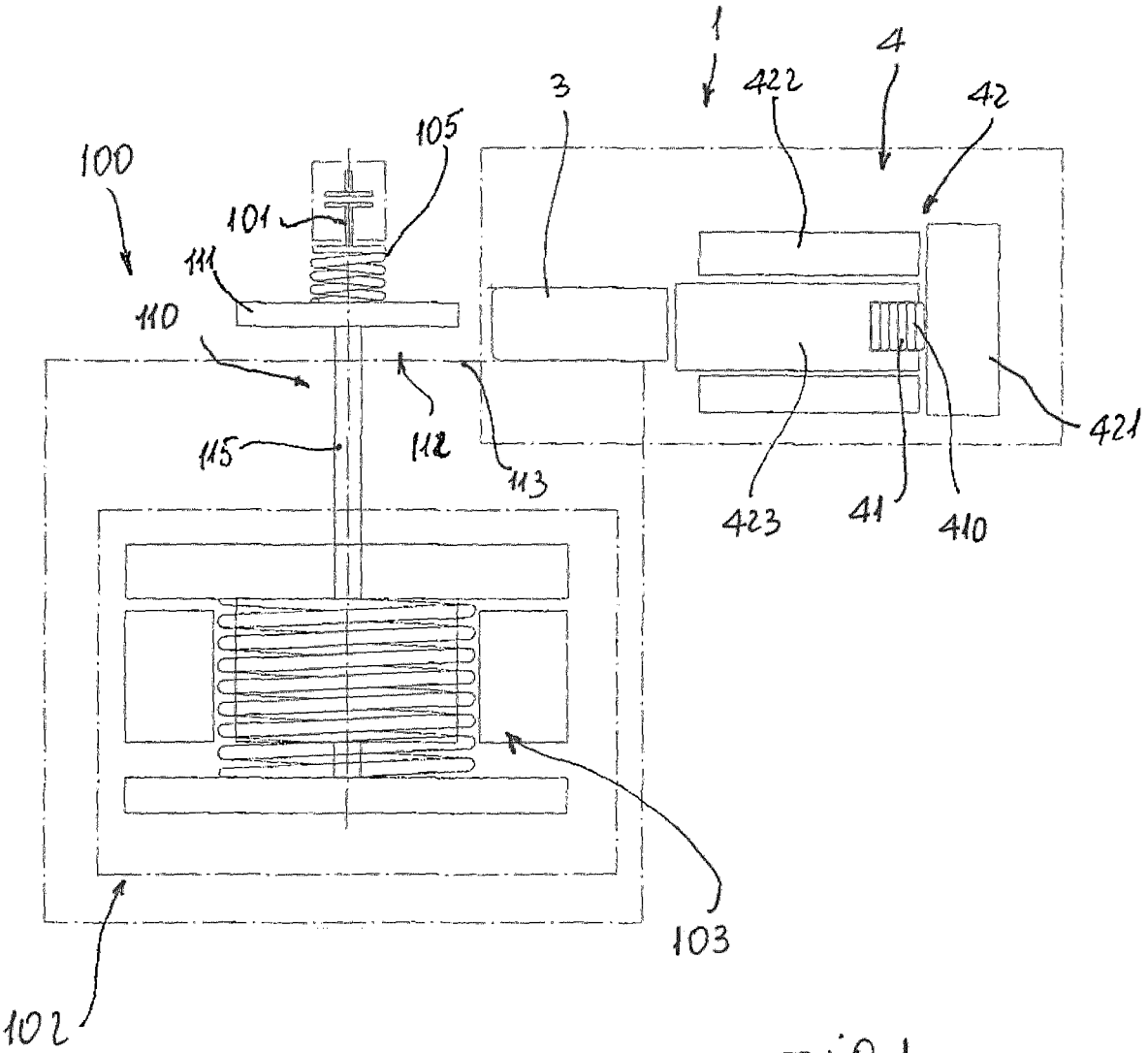
FIG. 1 is a schematic view of a first embodiment of a mechanical latching accessory kit and a Medium Voltage contactor according to the invention, in a first position (contact open—latching element in the resting position)

With reference to the attached Figures, a mechanical latching accessory kit according to the invention—designated by the reference numeral 1—is adapted to be used with a Medium Voltage contactor—designated by the reference numeral 100.

The Medium Voltage contactor 100 generally comprises one or more movable contacts 100 connected through a mechanical link 110 to a contact actuator 102. According to the needs, the contact actuator 102 can be of different kinds and have different features and it is used to move said one or more movable contacts 101 between a contact open position (e.g. FIG. 1) and a contact closed position (e.g. FIG. 2).

The mechanical latching accessory kit 1 of the present invention, in its more general definition, comprises a supporting interface 2 which is used for fixing the mechanical latching accessory kit 1 on a Medium Voltage contactor 100, normally on the front side of said Medium Voltage contactor 100.

Then, mechanical latching accessory kit 1 comprises a latching element 3 which is movable between a first operating position and a second resting position and a latching actuating system 4 moving said latching element 3 between said first, operating, position and said second, resting, position, according to operating principles better described hereinafter.

Figure 2:
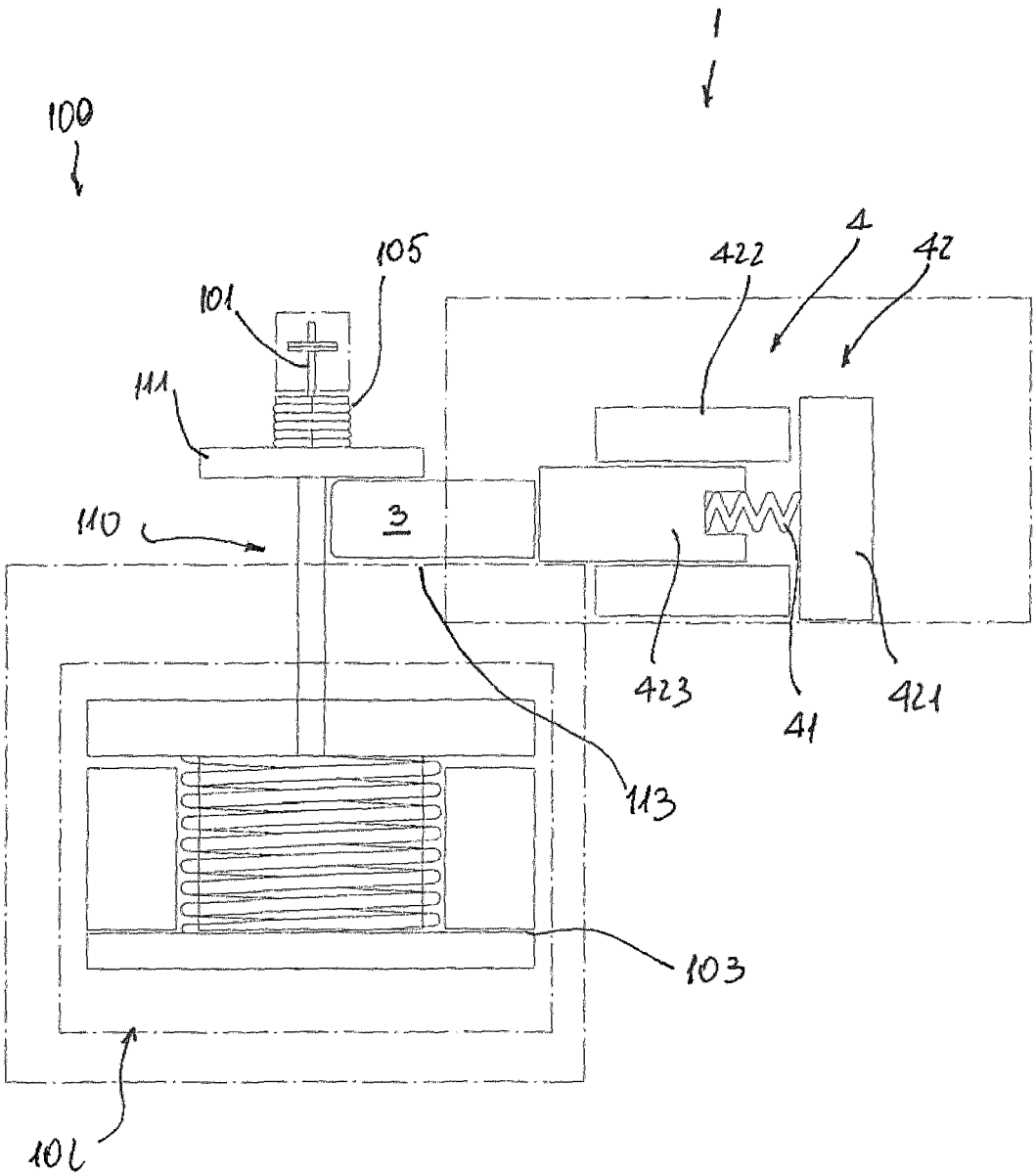
FIG. 2 is a schematic view of a first embodiment of a mechanical latching accessory kit and a Medium Voltage contactor according to the invention, in a second position (contact closed—latching element in the operating position—contact latched)

The latching element 3 of the mechanical latching accessory kit 1 is adapted—when it is in said first operating position—to cooperate with the mechanical link 110 of said Medium Voltage contactor 100 to latch said one or more movable contacts 101 (as schematically represented in FIG. 2), and—when it is in said second resting position—to release said one or more movable contacts 101 (as schematically represented in FIG. 1).

In a preferred embodiment of the mechanical latching accessory kit 1 of the present invention, the latching actuating system 4 comprises a first, mechanical, latching actuator 41 which moves the latching element 3 from the second resting position to said first operating position.

Furthermore, the latching actuating system 4 comprises a second, electromagnetic, unlatching actuator 42 which moves the latching element 3 from said first operating position to said second resting position.

With particular reference to FIGS. 1-3 and 7, the latching actuating system 4 comprises preferably a first, mechanical, latching actuator 41 which is provided with an elastic element 410 snap-moving the latching element 3 from said second resting position to said first operating position.

In particular, the elastic element 410 of the first, mechanical, latching actuator 41 can be a compression spring which is compressed when said latching element 3 is in said second resting position and is released when said latching element 3 is in said first operating position. Thus, as shown in the attached figures, when the contact(s) of the Medium Voltage contactor 100 are in the closed and latched position (e.g. FIGS. 2 and 3), the compression spring is extended in a stable position, whereas when the contact(s) of the Medium Voltage contactor 100 are in the open position (e.g. FIG. 1), the compression spring is compressed in a loaded position and is ready to carry out a latching operation of the Medium Voltage contactor 100 by moving the latching element 3 in its first operating position.

Then, the latching actuating system 4 preferably comprises also a second, electromagnetic, unlatching actuator 42 which, when energized, moves said latching element 3 from said first operating position to said second resting position contrasting the action of said first, mechanical, latching elastic actuator 410. Thus, when the latching element 3 is in its first operating position latching the contact(s) of the Medium Voltage contactor 100, the first, mechanical, latching actuator 41 (i.e., in the embodiment shown, the compression spring 410) are in a stable condition and the second, electromagnetic, unlatching actuator 42 are not energized.

In a detailed preferred embodiment of the mechanical latching accessory kit 1 of the present invention said second, electromagnetic, unlatching actuator can preferably comprise a fixed magnetic yoke 421, a coil 422, and a movable magnetic plunger 423 which is positioned inside said coil 422. By energizing/de-energizing the coil 422, the magnetic plunger 423 is linearly moved in and out according to well-known operating and design principles.

Accordingly, the magnetic plunger 423, which is operatively connected to the latching element 3, moves said latching element 3 between said first, operating, position and said second resting position under the action of the first, mechanical, latching actuator 41 (i.e., in the embodiment shown, the compression spring 410); then, when the coil 422 is energized, the magnetic plunger 423 is withdrawn inside the magnetic yoke 421 and moves said latching element 3 between the second resting position and said first, operating, position. At the same time, during such movement, the elastic means of the first, mechanical, latching actuator 41 (i.e., in the embodiment shown, the compression spring 410) are loaded and brought in condition to carry out latching operation again.

As shown in the attached figures, the compression spring has one end advantageously rigidly connected to said fixed magnetic yoke 421 and the other end rigidly connected to said movable magnetic plunger 423, thereby realizing a very simple but very effective system for moving the latching element 3 between the latching an unlatching positions of the contact(s) of the Medium Voltage contactor 100.

According to a particular embodiment of the mechanical latching accessory kit 1 of the present invention, switching means 5 can be provided to switch on and off the feeding current of said second, electromagnetic, unlatching actuator 42. In practice, a micro-switch 5 can be appropriately positioned on the mechanical latching accessory kit 1 so as to switch on and off the excitation current of the coil 422 depending on the position of the magnetic plunger 423, and consequently on the latched/unlatched conditions of the contact(s) of the Medium Voltage contactor 100.

Furthermore, the second, electromagnetic, unlatching actuator 42 is conveniently provided with a current supply system for handling, e.g., the excitation current of said coil 422. For instance, said current supply system can advantageously comprise a rectifier, preferably a diode rectifier, for handling both DC and AC supply for the excitation current of said coil 422.

As shown in the attached figures, and as better explained in the following description of preferred embodiments of the present invention, the latching element 3 is intended to be inserted in a space between a movable part of the mechanical link 110 and a fixed part of the Medium Voltage contactor 100, so as to latch the mechanical link 110 and consequently the contact(s) part of the Medium Voltage contactor 100 in a desired position. During the insertion (and extraction) of the latching element 3 into (and from) said space, considerable friction may arise between the latching element 3 and the mechanical link 110 and/or other parts of the Medium Voltage contactor 100.

In order to reduce such friction, in a preferred embodiment of the mechanical latching accessory kit 1 of the present invention, the latching element 3 is preferably provided with means 35 for reducing such friction, for example one or more roller bearings 31, 32 positioned on said latching element 3 so as to interact with the mechanical link 110 and/or other parts of the Medium Voltage contactor 100 during the insertion/extraction of the latching element 3 into/from said space.

In a particular embodiment of the mechanical latching accessory kit 1 of the present invention, the latching actuating system 4 can conveniently comprises also a manual unlatching actuator 43, for instance an operating handle or knob, for moving said latching element 3 from said first operating position to said second resting position. In other words, the manual unlatching actuator 43 is intended to be used for carrying out a manual emergency tripping of the latching system. In practice, in an exemplary embodiment of the present invention, when the latching element 3 is in its said first operating position (latching condition of the Medium Voltage contactor 100), by manually pulling the operating handle or knob 43 against the action of the spring 410, the latching element 3 is brought into the second resting position (unlatching condition of the Medium Voltage contactor 100), thereby releasing the mechanical link 110 of said Medium Voltage contactor 100.

In a further aspect, the present invention also relates to a Medium Voltage contactor 100 comprising a mechanical latching accessory kit 1 as described in the present disclosure.

With reference to the attached figures, the Medium Voltage contactor 100 of the present disclosure, comprises one or more movable contacts 101, which are connected through a mechanical link 110 to a contact actuator 102 moving said one or more movable contacts 101 between a contact open position (e.g., as represented in FIG. 1) and a contact closed position (e.g., as represented in FIG. 2). Although a three pole 200 contactor 100 is represented in the attached figures, other configurations of the Medium Voltage contactor 100 are also possible.

In the embodiment shown, the latching element 3 of the mechanical latching accessory kit 1 previously described cooperates with the mechanical link 110 of said Medium Voltage contactor 100 for latching said one or more contacts 101 in said closed position. In practice, the Medium Voltage contactor 100 can be a basic, electrically latched, Medium Voltage contactor which has been up-graded to a mechanically latched Medium Voltage contactor by using the mechanical latching accessory kit 1 previously described.

Figure 3:
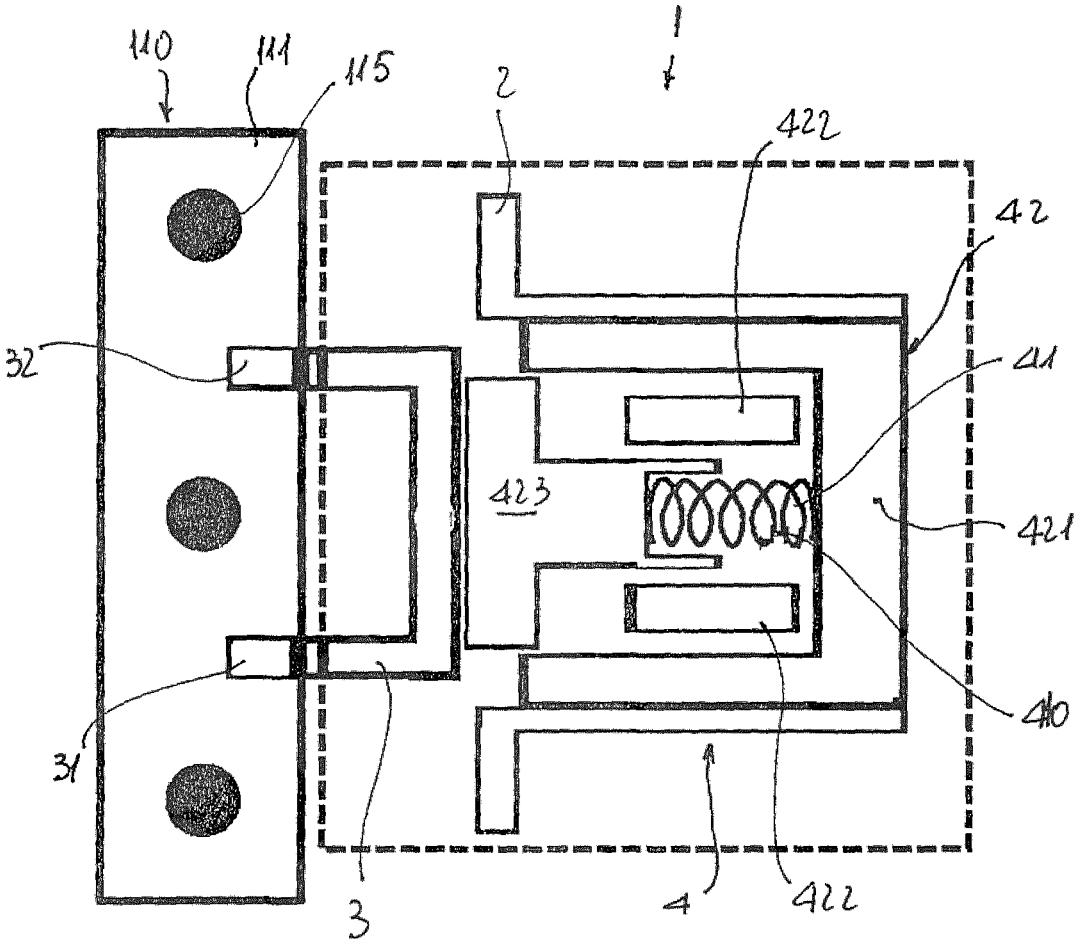
FIG. 3 is a schematic view of a second embodiment of a mechanical latching accessory kit and part of the mechanical link of a Medium Voltage contactor according to the invention, in a contact closed position (contact closed—latching element in the operating position—contact latched)
Figure 4:
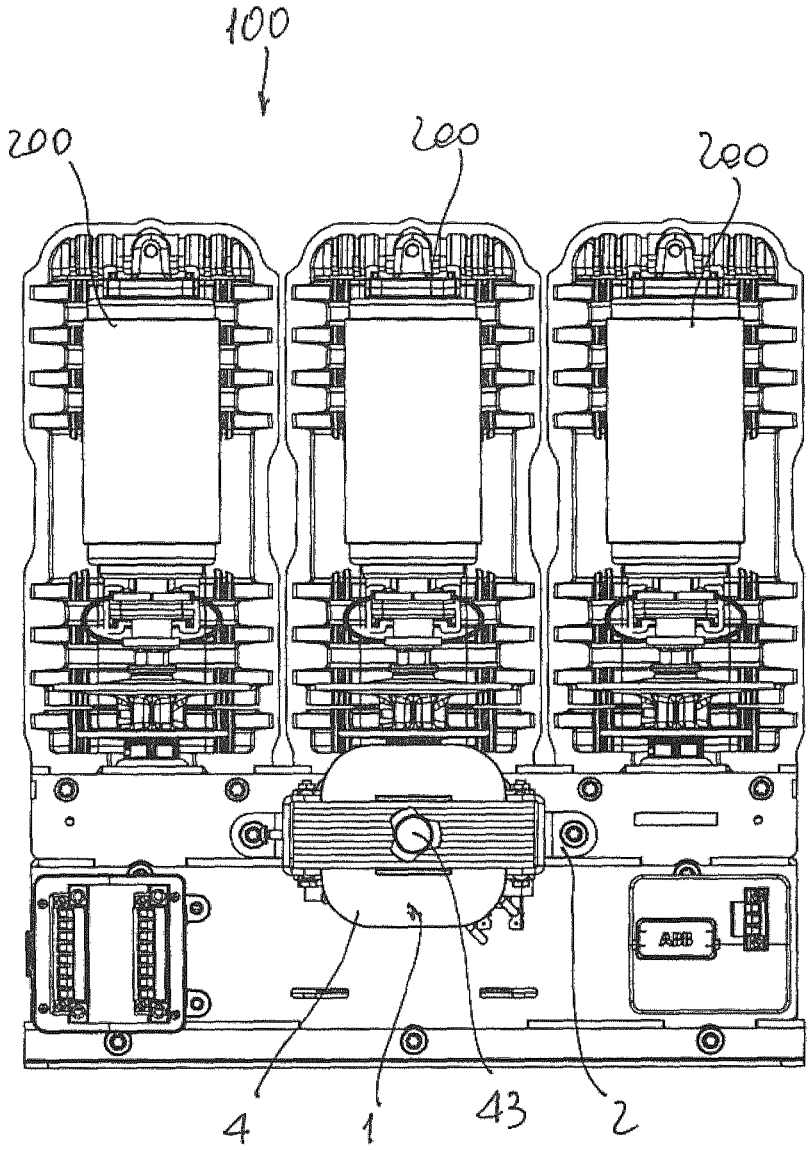
FIG. 4 is a front view of a Medium Voltage contactor equipped with a mechanical latching accessory kit, according to the invention.
Figure 5:
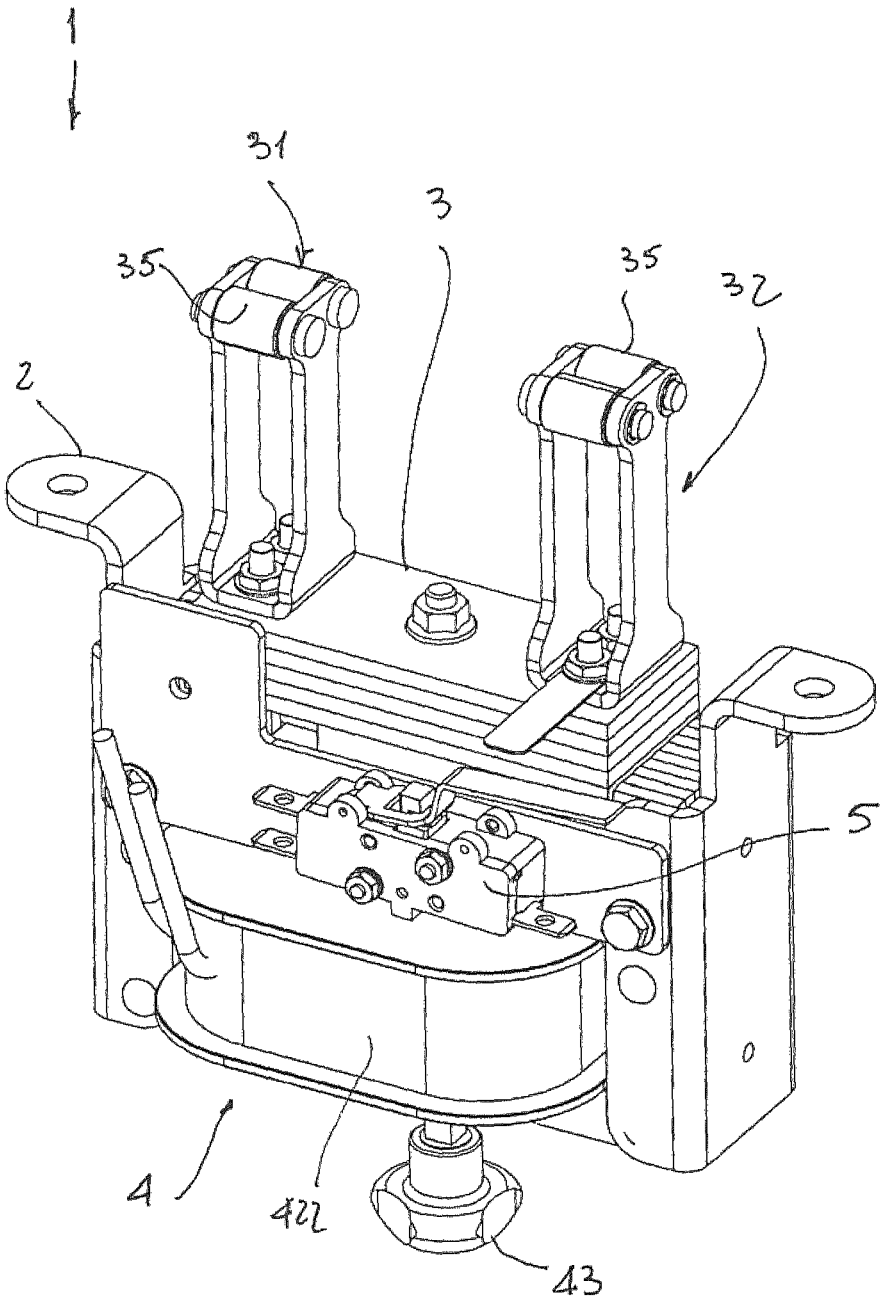
FIG. 5 is a first perspective view of a third embodiment of a mechanical latching accessory kit, according to the invention.
Figure 6:
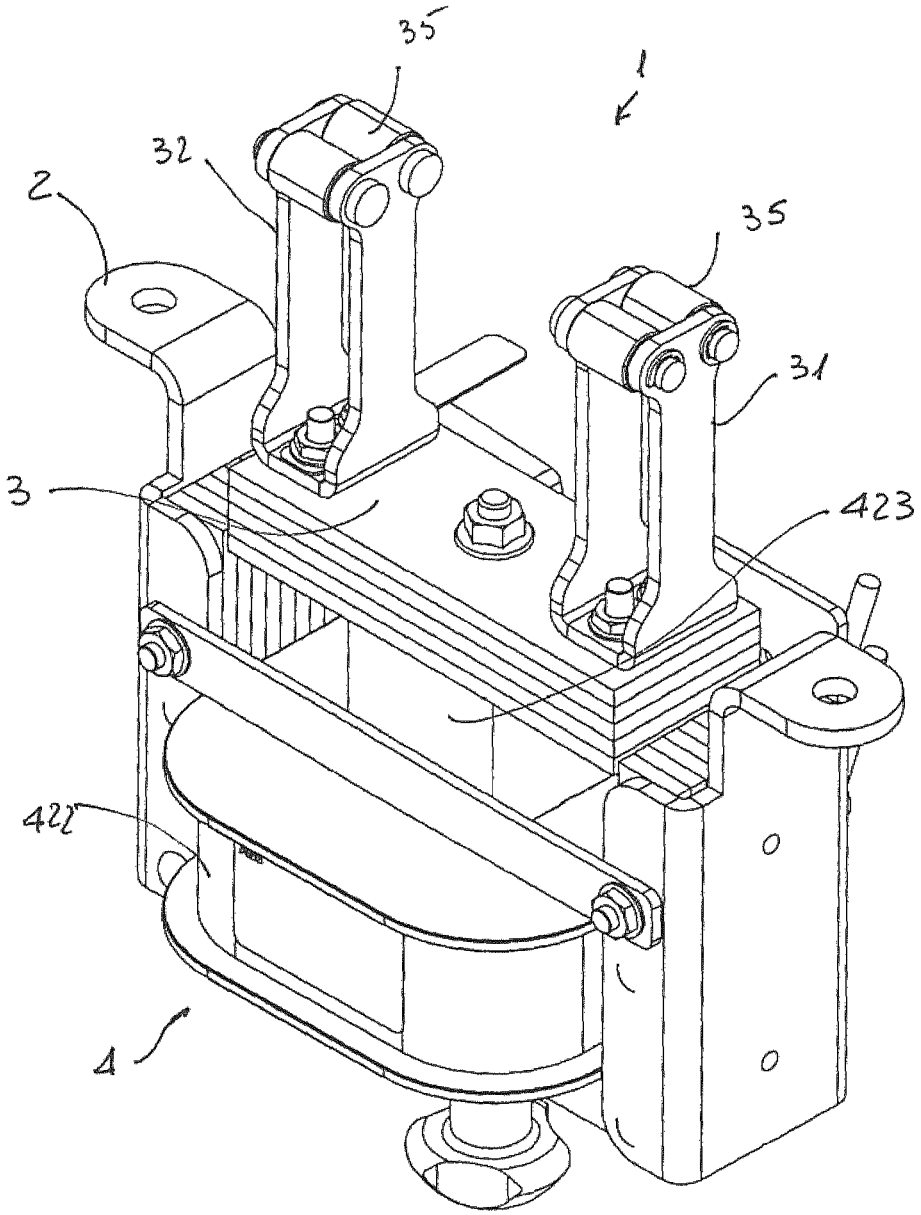
FIG. 6 is a second perspective view of a third embodiment of a mechanical latching accessory kit, according to the invention.
Figure 7:
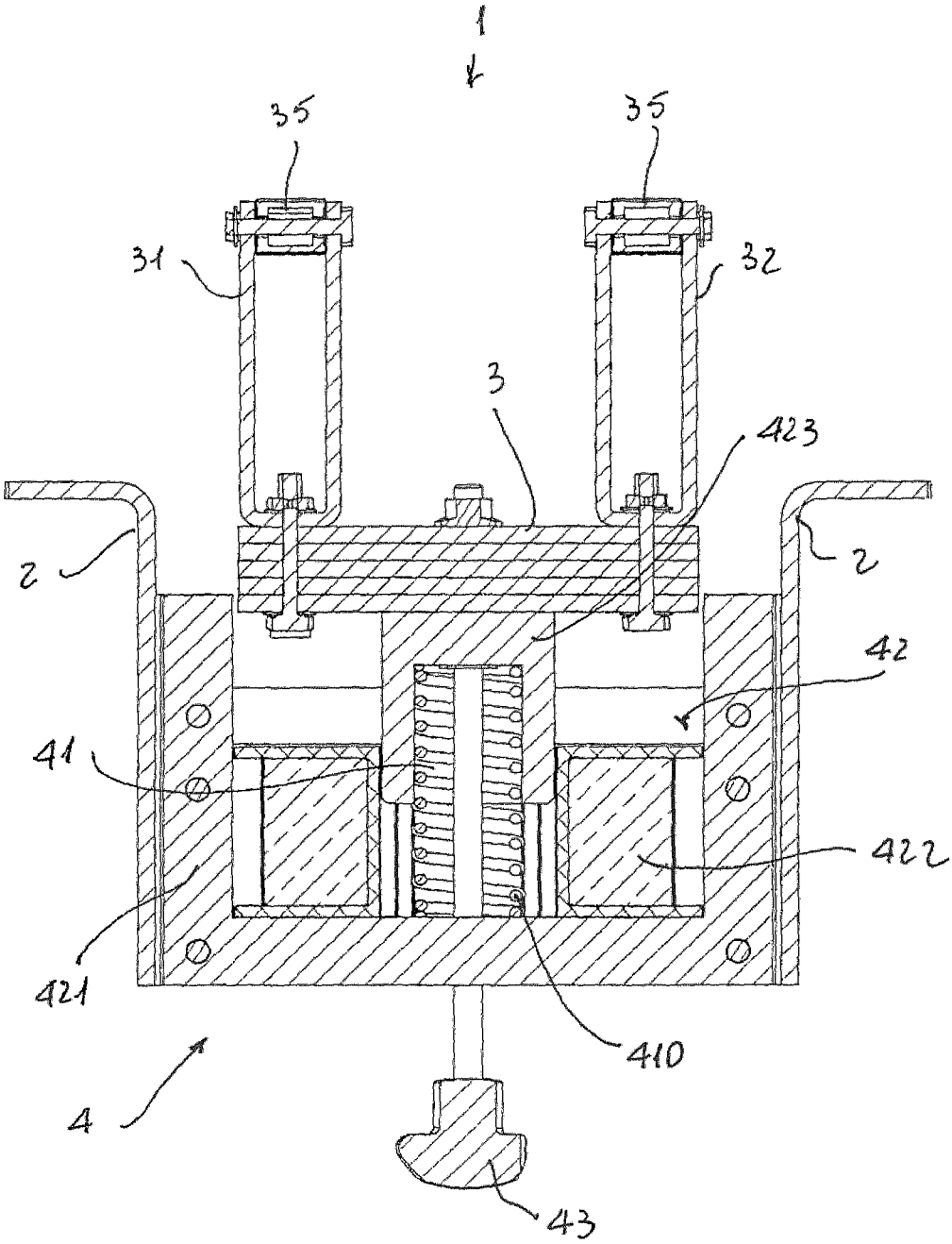
FIG. 7 is a section view of a third embodiment of a mechanical latching accessory kit, according to the invention.
Figure 8:
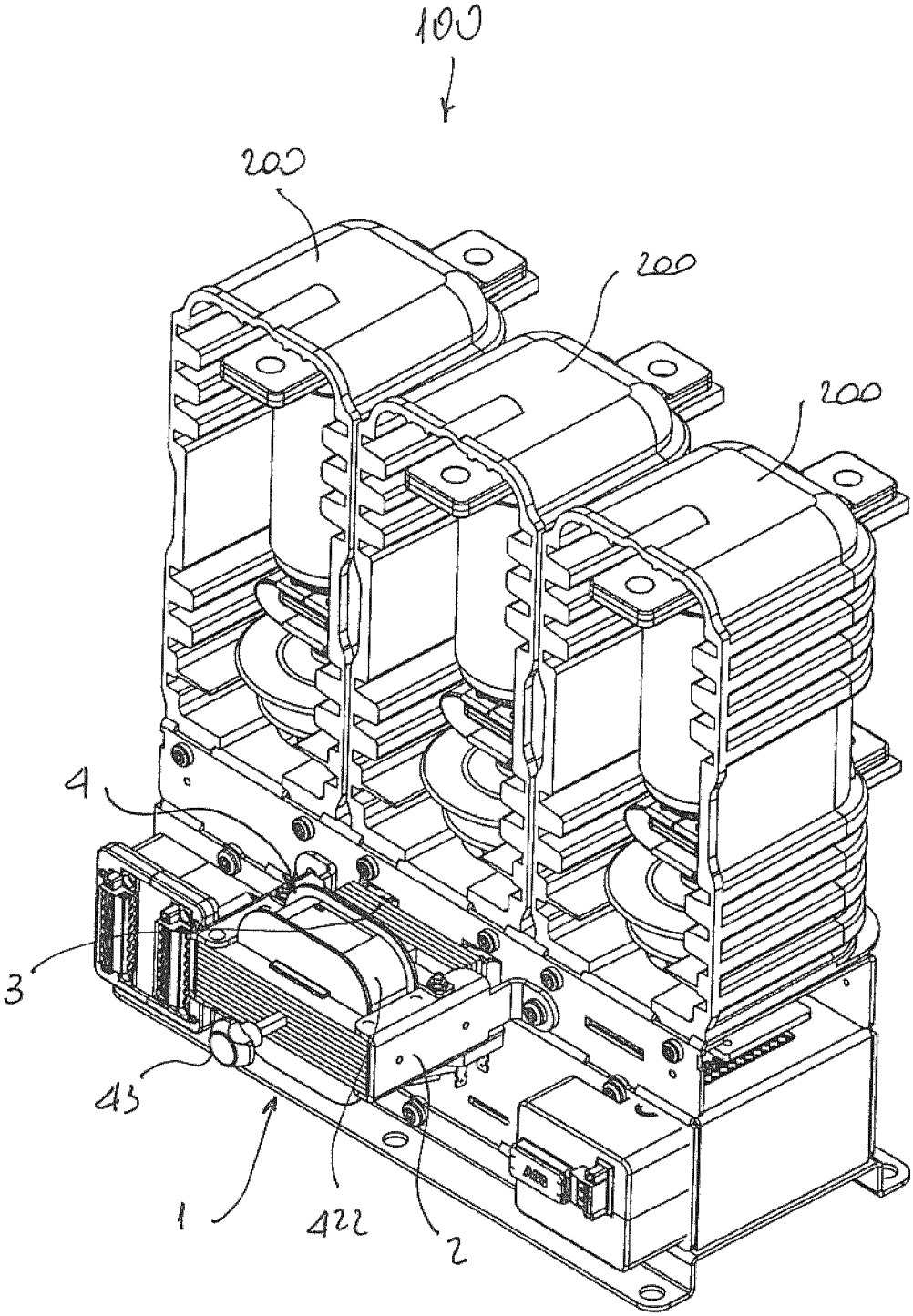
FIG. 8 is a perspective view of a Medium Voltage contactor equipped with a mechanical latching accessory kit, according to the invention.
Figure 9:
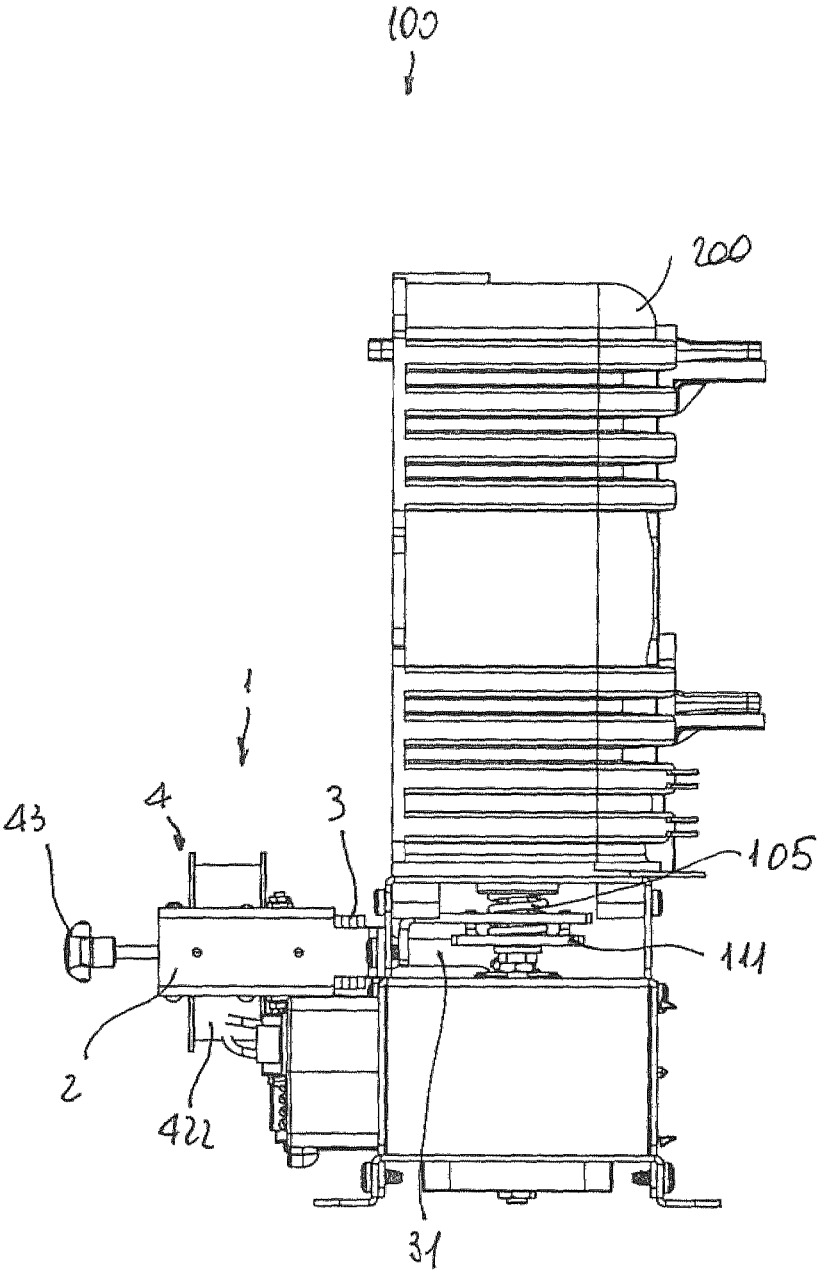
FIG. 9 is a front view of a Medium Voltage contactor equipped with a mechanical latching accessory kit, according to the invention.

In a typical embodiment of the Medium Voltage contactor 100 of the present invention, the contact actuator 102 conveniently comprises electromagnetic means 103 which are energized to move said one or more movable contacts 101 from said contact open position to said contact closed position, and spring means 105 for moving said one or more contacts 101 from said contact closed position to said contact open position As schematically shown in FIGS. 2 and 3, the latching element 3 of the mechanical latching accessory kit 1 cooperates with the mechanical link 110 of said Medium Voltage contactor 100 for latching the contact(s) 101 in said closed position.

Accordingly, when said one or more contacts 101 are in the contact closed position, the electromagnetic means 103 of said contact actuator 102 can be de-energized, since the contact closure condition is maintained by the mechanical interference between the mechanical link 110 of the Medium Voltage contactor 100 and the latching element 3 of the mechanical latching accessory kit 1.

In a typical example of a Medium Voltage contactor 100, according to the present invention, the mechanical link 110 of said Medium Voltage contactor 100 comprises a rod 111 which is operatively connected to a linearly movable member of said contact actuator 102 on to said one or more movable contacts 101, e.g. thorough a second actuating rod 115.

The rod 111 linearly moves between said contact open position and said contact closed position, and is placed with its longitudinal axis perpendicular with respect to the direction of its linear movement; in the embodiment shown, the rod 111 is perpendicularly connected to the second actuating rod 115 so that the longitudinal axis of the second actuating rod 115 is perpendicular to the longitudinal axis of the rod 111 and substantially parallel to the direction of movement, so that the linear movement of the one or more movable contacts 101 and of the movable member of the contact actuator 102.

In the embodiment shown, when said one or more movable contacts 101 are in the closed position, the latching element 3 of said mechanical latching accessory 1 is inserted in a space 112 between said rod 111 and a fixed element 113 of said Medium Voltage contactor 100, for instance the frame of said Medium Voltage contactor 100 or another fixed part thereof.

The mechanical latching accessory 1 and is then extracted from said space 112 when said one or more movable contacts 100 are in the open position.

Typically, the contact actuator 102 of the Medium Voltage contactor 100, can comprise electromagnetic means 103 which are energized to move said rod 111 from said contact open position to said contact closed position.

In practice, the contact actuator 102 conveniently comprises a linear monostable electromagnetic actuator 103, having a coil, a fixed armature and a movable plunger which is connected to the one or more contact(s) 101, with a mechanical link 110 comprising, e.g., the rod 111 and/or the second actuating rod 115. Once said one or more contacts 101 are in the contact closed position, the latching element 3 of the mechanical latching accessory kit 1 is urged in the operating position in the space 112 between the rod 111 and a fixed element 113 of the Medium Voltage contactor 100.

Under these conditions, the contact(s) 101 of the Medium Voltage contactor 100 are latched in the closed position, and the electromagnetic means 103 of said contact actuator 102 can be therefore de-energized.

Furthermore, the contact actuator 102 conveniently comprises spring means 105 for moving said rod 111 (and/or said second actuating rod 115) from said contact closed position to said contact open position.

So, in order to carry out the unlatching operation of the contact(s) 101 of the Medium Voltage contactor 100 (e.g. following a tripping command of the Medium Voltage contactor 100), the coil 422 of the second, electromagnetic, unlatching actuator 42 of the mechanical latching accessory kit 1 is excited, and the latching element 3 of said mechanical latching accessory kit 1 moves from the inserted position in the space 112 between the rod 111 and a fixed element 113 of said Medium Voltage contactor 100 into an extracted position outside said space 112 (unlatching operation).

Under these conditions, the spring means 105 of the contact actuator 102 pull the rod 111 (and/or said second actuating rod 115) from the contact closed position to the contact open position, thereby carrying out the opening operation of the contact(s) 101 of the Medium Voltage contactor 100.

Several variations can be made to the mechanical latching accessory kit for Medium Voltage contactors and to the Medium Voltage contactor thus conceived, all falling within the scope of the attached claims. In practice, the materials used and the contingent dimensions and shapes can be any, according to requirements and to the state of the art.

The invention claimed is:

1. A mechanical latching accessory kit for a Medium Voltage contactor comprising one or more movable contacts connected through a mechanical link to a contact actuator moving said one or more movable contacts between a contact open position and a contact closed position, the mechanical latching accessory kit comprises:

a supporting interface adapted to be fixed to and removed from said Medium Voltage contactor;

a latching element movable between a first operating position and a second resting position; and a latching actuating system moving said latching element between said first operating position and said second resting position;

wherein said latching element being adapted, when said latching element is in said first operating position, to cooperate with the mechanical link of said Medium Voltage contactor to latch said one or more movable contacts, and, when said latching element is in said second resting position, to release said one or more movable contacts.

2. The mechanical latching accessory kit according to claim 1, wherein said latching actuating system comprises:

a first mechanical latching actuator moving said latching element from said second resting position to said first operating position, and a second electromagnetic unlatching actuator moving said latching element from said first operating position to said second resting position.

3. The mechanical latching accessory kit according to claim 2, further comprising switching means to switch on and off a feeding current of said second electromagnetic unlatching actuator.

4. The mechanical latching accessory kit according to claim 3, further comprising a rectifier for handling both DC and AC supply of feeding current of said second electromagnetic unlatching actuator.

5. The mechanical latching accessory kit according to claim 2, wherein said latching actuating system comprises a first mechanical latching elastic actuator snap-moving said latching element from said second resting position to said first operating position and said second electromagnetic unlatching actuator which, when energized, moves said latching element from said first operating position to said second resting position contrasting actuation of said first mechanical latching elastic actuator.

6. The mechanical latching accessory kit according to claim 1, wherein said latching actuating system comprises:

a first mechanical latching elastic actuator snap-moving said latching element from said second resting position to said first operating position, and a second electromagnetic unlatching actuator which, when energized, moves said latching element from said first operating position to said second resting position contrasting actuation of said first mechanical latching elastic actuator.

7. The mechanical latching accessory kit according to claim 6, wherein said first mechanical latching elastic actuator is a compression spring which is compressed when said latching element is in said second resting position and is released when said latching element is in said first operating position.

8. The mechanical latching accessory kit according to claim 7, wherein said second electromagnetic unlatching actuator comprises a fixed magnetic yoke, a coil, and a movable magnetic plunger positioned inside said coil and operatively connected to said latching element, wherein said movable magnetic plunger moving said latching element between said first, operating, position and said second resting position.

9. The mechanical latching accessory kit according to claim 8, wherein said compression spring has one end rigidly connected to said fixed magnetic yoke and an other end rigidly connected to said movable magnetic plunger.

10. The mechanical latching accessory kit according to claim 9, wherein said compression spring has one end rigidly connected to said fixed magnetic yoke and the other end rigidly connected to said movable magnetic plunger.

11. The mechanical latching accessory kit according to claim 6, wherein said second electromagnetic unlatching actuator comprises a fixed magnetic yoke, a coil, and a movable magnetic plunger positioned inside said coil and operatively connected to said latching element, said movable magnetic plunger moving said latching element between said first operating position and said second resting position.

12. The mechanical latching accessory kit according to claim 6, further comprising switching means to switch on and off a feeding current of said second, electromagnetic, unlatching actuator.

13. The mechanical latching accessory kit according to claim 1, wherein said latching element is provided with means for reducing a friction with the mechanical link and/or other parts of said Medium Voltage contactor.

14. The mechanical latching accessory kit according to claim 1, wherein said latching actuating system comprises a manual unlatching actuator moving said latching element from said first operating position said second resting position.

15. A Medium Voltage contactor comprising the mechanical latching accessory kit according to claim 1.

16. The Medium Voltage contactor according to claim 15, wherein said contact actuator comprises an electromagnetic actuator configured to move said one or more movable contacts from said contact open position to said contact closed position when energized, and a spring means for moving said one or more contacts from said contact closed position to said contact open position, said latching element of said mechanical latching accessory kit cooperating with the mechanical link of said Medium Voltage contactor for latching said one or more contacts in said closed position.

17. The Medium Voltage contactor according to claim 16, wherein when said one or more contacts are in the contact closed position, the electromagnetic actuator of said contact actuator are de-energized.

18. The Medium Voltage contactor according to claim 16, wherein the mechanical link of said Medium Voltage contactor comprises a rod operatively connected to said one or more movable contacts and linearly moving between said contact open position and said contact closed position, said rod being placed with a longitudinal axis perpendicular with respect to a direction of linear movement of said rod, the latching element of said mechanical latching accessory being inserted in a space between said rod and a fixed element of said Medium Voltage contactor when said one or more movable contacts are in the closed position and being extracted from said space when said one or more movable contacts are in the open position.

19. The Medium Voltage contactor according to claim 15, wherein the mechanical link of said Medium Voltage contactor comprises a rod operatively connected to said one or more movable contacts and linearly moving between said contact open position and said contact closed position, said rod being placed with a longitudinal axis perpendicular with respect to a direction of linear movement of said rod, the latching element of said mechanical latching accessory being inserted in a space between said rod and a fixed element of said Medium Voltage contactor when said one or more movable contacts are in the closed position and being extracted from said space when said one or more movable contacts are in the open position.

20. The Medium Voltage contactor according to claim 19, wherein said contact actuator comprises an electromagnetic actuator configured to move said rod from said contact open position to said contact closed position when energized, and spring means for moving said rod from said contact closed position to said contact open position, said electromagnetic actuator of said contact actuator being de-energized when said one or more contacts are in the contact closed position, said latching actuating system of said mechanical latching accessory kit being energized to move the latching element of said mechanical latching accessory kit from an inserted position in the space between said rod and a fixed element of said Medium Voltage contactor and an extracted position from said space.

* * * * *